US008235759B1

(12) United States Patent
Belter et al.

(10) Patent No.: US 8,235,759 B1
(45) Date of Patent: Aug. 7, 2012

(54) ENGINE COOLING SYSTEM DRAIN

(75) Inventors: David J. Belter, Oshkosh, WI (US); Brian R. White, Stillwater, OK (US); Jerry M. Stoll, Jr., Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 179 days.

(21) Appl. No.: 12/839,133

(22) Filed: Jul. 19, 2010

(51) Int. Cl.
*B63H 21/14* (2006.01)

(52) U.S. Cl. ..... 440/88 C; 114/183 R; 114/197

(58) Field of Classification Search ..... 114/183 R, 114/197, 184, 198; 440/88 C, 88 N
See application file for complete search history.

(56) References Cited

U.S. PATENT DOCUMENTS

| | | | | |
|---|---|---|---|---|
| 4,512,547 | A | 4/1985 | Balch | |
| 6,050,867 | A * | 4/2000 | Shields et al. | 440/88 C |
| 7,175,491 | B1 | 2/2007 | Davis et al. | |
| 7,191,722 | B1 * | 3/2007 | Plost | 114/197 |
| 7,354,324 | B1 | 4/2008 | Jaszewski et al. | |

* cited by examiner

*Primary Examiner* — Lars A Olson
(74) *Attorney, Agent, or Firm* — Andrus, Sceales, Starke & Sawall, LLP

(57) ABSTRACT

A liquid cooled internal combustion engine has a cooling system with a coolant liquid flow passage having a drain port and a clog-preventing drain plug having an anti-clog protrusion finger extending through the drain port and into the coolant liquid flow passage when the clog-preventing drain plug is in its closed position. The anti-clog protrusion finger leaves a hole in a clog layer of debris and/or engine combustion products upon removal of the anti-clog protrusion finger from the coolant liquid flow passage upon moving the clog-preventing drain plug to its open position.

24 Claims, 3 Drawing Sheets

ENGINE COOLING SYSTEM DRAIN

BACKGROUND AND SUMMARY

The invention relates to cooling systems for internal combustion engines, including marine sterndrives.

Marine sterndrives typically require winterization upon removing the boat from the water, including draining water from the engine's cooling system, to prevent engine damage which may otherwise occur due to freezing of such water, e.g. a cracked engine block.

The invention arose during continuing development efforts in the above product lines, and has application therebeyond.

DETAILED DESCRIPTION

Figure 1:
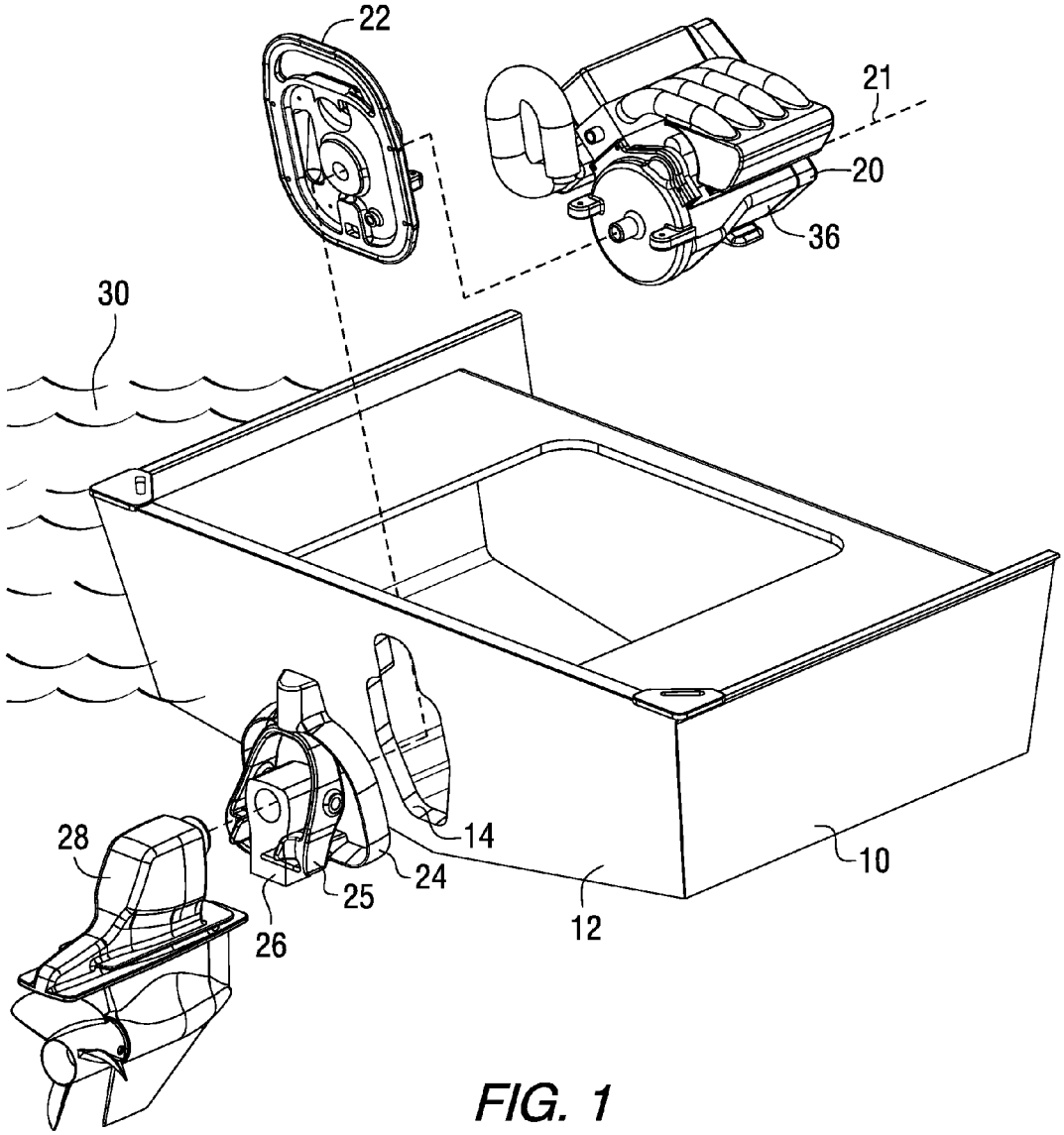
FIG. 1 PRIOR ART
FIG. 1 is an exploded perspective partial view of a marine sterndrive in a marine vessel.

FIG. 1 is taken from FIG. 1 of U.S. Pat. No. 7,354,324, incorporated herein by reference, for illustrating the prior art. A marine vessel 10 is shown with a transom 12 having a hole 14 formed through it. Also shown in FIG. 1 is an engine 20, a transom bracket 22, a transom ring 24, a gimbal ring 25, a bell housing 26, and a marine drive unit 28. As is well known to those skilled in the art, the assembly procedure attaches the transom bracket 22 to an inside surface of the transom 12 and the transom ring 24 to an outside surface of the transom 12. The transom bracket 22 and the transom ring 24 are attached together with the transom 12 therebetween. The gimbal ring is pivotally attached to the transom ring 24 and the bell housing 26 is pivotally attached to the gimbal ring 25. The engine 20 is shown with its crankshaft axis 21. As is known, the engine has a cooling system which may be an open cooling system circulating water therethrough from the body of water 30 in which the vessel is operating, or the cooling system may be a hybrid system having both a closed cooling system and an open cooling system, the closed cooling system circulating coolant liquid, e.g. water or ethylene glycol or the like or a combination thereof, and the open cooling system circulating water from body of water 30 through a heat exchanger which then cools the coolant liquid in the closed cooling system, all as is known. The cooling system, including one or both of the noted open and closed systems, typically includes a drain port, to be described, for draining coolant liquid, particularly water, from the cooling system, for winterization upon taking vessel 10 out of the water, to in turn protect the engine from damage which may otherwise occur due to freezing of water left in the cooling system, e.g. which may otherwise cause a cracked engine block.

Figure 2:
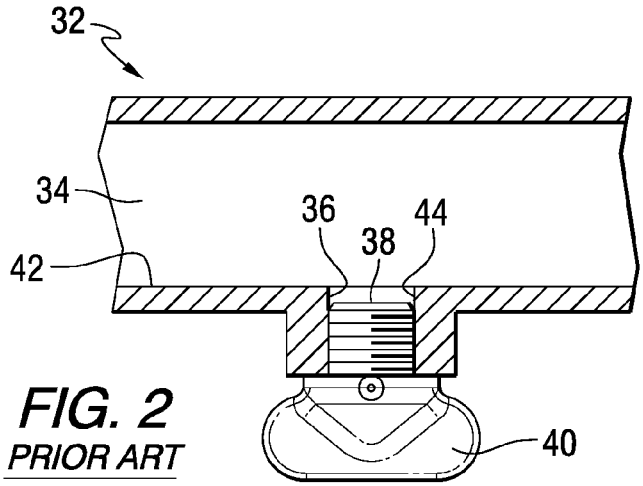
FIG. 2 PRIOR ART
FIG. 2 is a side view partially in section of a portion of the cooling system of the internal combustion engine of the marine sterndrive of FIG. 1, and illustrates prior art.

FIG. 2 shows a portion of the cooling system 32 for the liquid cooled marine internal combustion engine 20 of marine vessel 10 operating in body of water 30. The cooling system circulates water therethrough from the body of water, and includes a coolant water flow passage 34 with a drain port 36 for seasonal draining of coolant water from water flow passage 34 to prevent freezing thereof. Drain port 36 is closable to block water from exiting therethrough, and is openable to permit water to exit therethrough for the noted seasonal draining of coolant water from water flow passage 34. FIG. 2 shows a standard drain plug 38 known in the prior art and having a closed position as shown in FIG. 2 matingly engaging and closing drain port 36, e.g. in threaded relation, to block water from exiting through the drain port, and has an open position opening the drain port, e.g. turning the drain plug to unscrew same from the drain port, to permit water to exit through the drain port for the noted seasonal draining of coolant water from water flow passage 34. Drain plug 38 may have a user-gripped or pliers-gripped tab or handle 40.

Figure 3:
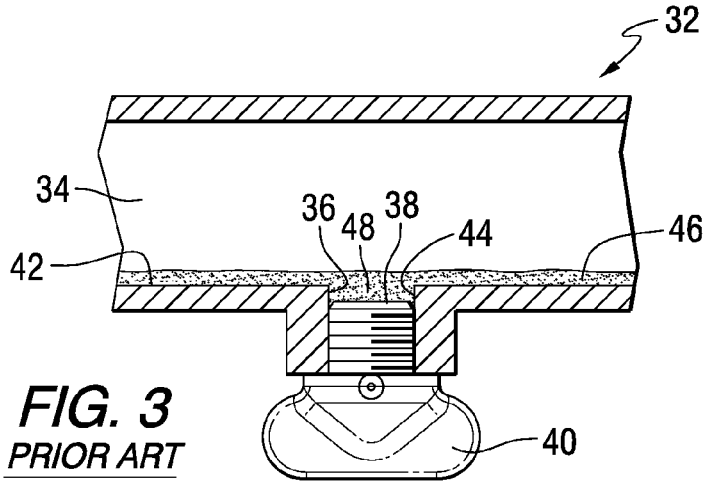
FIG. 3 PRIOR ART
FIG. 3 is like FIG. 2 and further illustrates the prior art.
Figure 4:
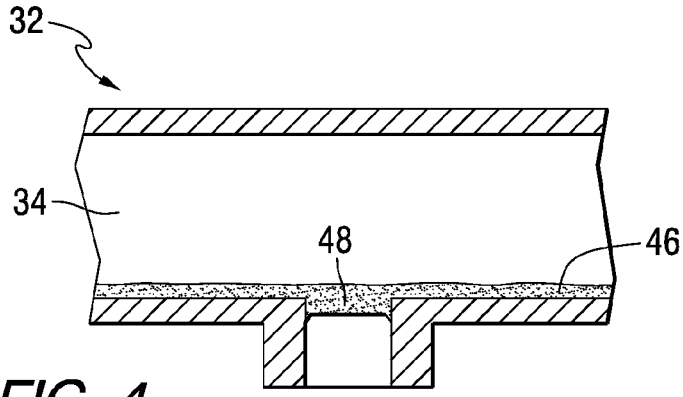
FIG. 4 PRIOR ART
FIG. 4 is like FIG. 3 and illustrates a problem encountered in the prior art.

Water flow passage 34 is subject to carrying debris from body of water 30 in which vessel 10 is operating and is also subject to carrying corrosion products of engine 20. Water flow passage 34 has a wall 42 along which water flows. The wall has a bore 44 therethrough providing drain port 36. Wall 42 including at drain port 36 is subject to formation of a clog layer 46, FIG. 3, of the noted debris and corrosion products. This clog layer at region 48 at the drain port may block and prevent drainage of water from water flow passage 34 through drain port 36 even if drain plug 38 is removed or otherwise in an open position, FIG. 4. Experienced boaters may know to clear drain port 36 at bore 44, e.g. by poking a wire or the like upwardly through the drain port to loosen the debris, and enable the water to drain. Inexperienced boaters may not know this.

Figure 5:
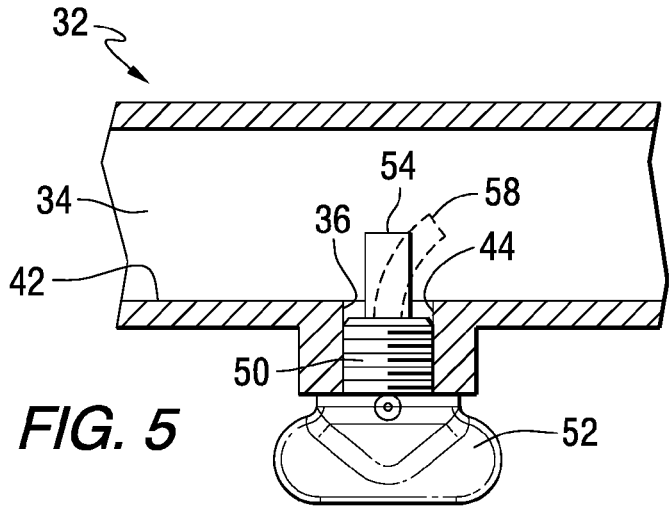
FIG. 5 is like FIG. 2 and shows the present invention.
Figure 6:
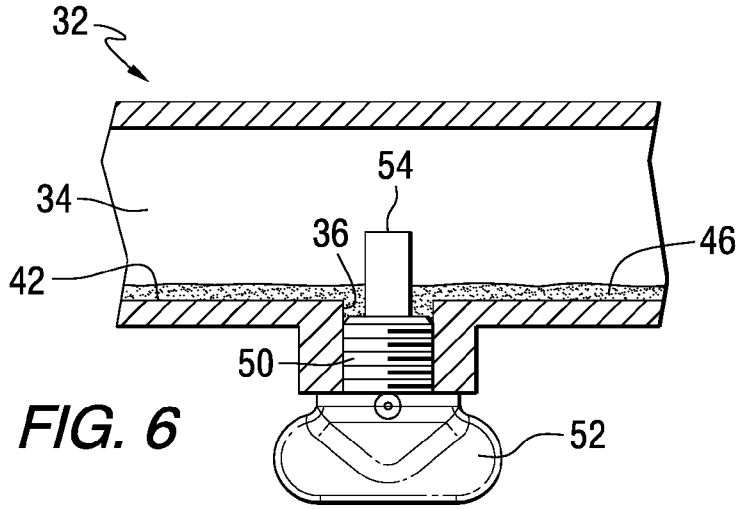
FIG. 6 is like FIG. 3 and illustrates the present invention.
Figure 7:
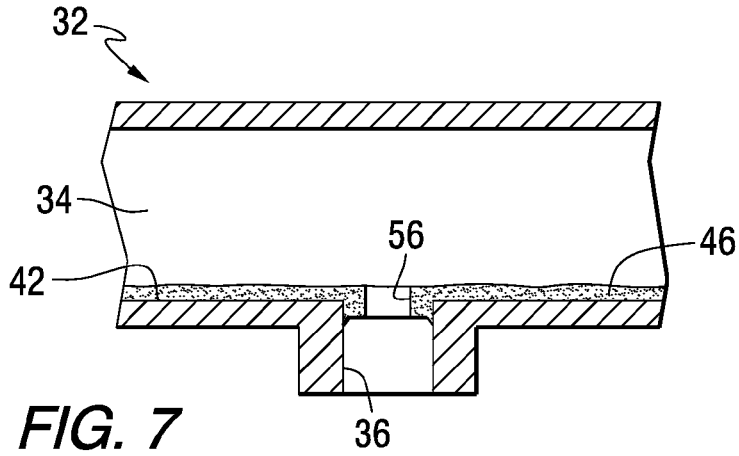
FIG. 7 is like FIG. 4 and illustrates the solution of the present invention.

FIG. 5 shows a clog-preventing replacement drain plug 50 matingly engageable with drain port 36 as above and having closed and open positions as above, and having a user-gripped or pliers-gripped tab or handle 52 as above. Clog-preventing replacement drain plug 50 has an anti-clog protrusion finger 54 extending through bore 44 and drain port 36 into water flow passage 34 when clog-preventing drain plug 50 is in its closed position, as shown in FIG. 5. Anti-clog protrusion finger 54 occupies space in water flow passage 34 otherwise subject to clogging, FIG. 6. Clog-preventing drain plug 50 is movable by the operator between the noted closed and open positions, e.g. by turning into or out of drain port 36, respectively. Anti-clog protrusion finger 54 leaves a hole 56, FIG. 7, in clog layer 46 upon removal of anti-clog protrusion finger 54 from water flow passage 34 upon moving clog-preventing drain plug 50 to its open position. This ensures that water will drain when the drain plug is removed or otherwise moved to its open position even if debris and/or corrosion products are present at clog layer 46.

The system provides an easy and effective method for preventing clogging of a drain port of a liquid cooled marine internal combustion engine by simply matingly engaging clog-preventing drain plug 50 with drain port 36 and extending anti-clog protrusion finger 54 through the drain port and into water flow passage 34 in the closed position of the clog-preventing drain plug. In such method, the clog-preventing drain plug 50 is simply moved to its open position by removing the drain plug from the drain port to remove anti-clog protrusion finger 54 from water flow passage 34 and leave a hole 56 in clog layer 46.

In an alternate embodiment, anti-clog protrusion finger 54 may be a flexible member, as shown at dashed line 58 in FIG. 5, bending around corners as needed.

In other embodiments, for various liquid cooled internal combustion engines, including marine engines and other engines, having a cooling system, whether open or closed or a hybrid thereof, the system provides a clog-preventing drain plug 50 having an anti-clog protrusion finger 54 extending through the drain port and into a coolant liquid flow passage through which coolant liquid flows, whether water or a chemical such as ethylene glycol or the like, or a mixture thereof, which anti-clog protrusion finger 54 leaves a hole in a clog layer formed by debris and/or engine combustion products, upon removal of the anti-clog protrusion finger from the coolant liquid flow passage upon removing the clog-preventing drain plug or otherwise moving it to an open position.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A liquid cooled internal combustion engine having a cooling system circulating coolant liquid therethrough and having a coolant liquid flow passage with a drain port for draining of coolant liquid from said coolant liquid flow passage, said drain port being closable to block coolant liquid from exiting therethrough, and being openable to permit coolant liquid to exit therethrough for draining of coolant liquid from said coolant liquid flow passage, said coolant liquid flow passage being subject to carrying corrosion products of said engine, said drain port being subject to clogging by said corrosion products which prevent drainage of coolant liquid from said coolant liquid flow passage through said drain port even if open, a clog-preventing drain plug matingly engageable with said drain port and having closed and open positions, said closed position matingly engaging and closing said drain port to block said coolant liquid from exiting therethrough, said open position opening said drain port to permit coolant liquid to exit therethrough for draining of coolant liquid from said coolant liquid flow passage, said clog-preventing drain plug having an anti-clog protrusion finger extending through said drain port and into said coolant liquid flow passage when said clog-preventing drain plug is in said closed position, wherein said anti-clog protrusion finger extending into said coolant liquid flow passage permits flow of said coolant liquid therepast when said clog-preventing drain plug is in said closed position, such that flow of said coolant liquid through said coolant liquid flow passage is not blocked by said anti-clog protrusion finger when said clog-preventing drain plug is in said closed position.

2. The liquid cooled internal combustion engine according to claim 1 wherein said anti-clog protrusion finger occupies space in said coolant liquid flow passage otherwise subject to clogging.

3. The liquid cooled internal combustion engine according to claim 2 wherein said clog-preventing drain plug is movable by an operator between said open and closed positions, and wherein said coolant liquid flow passage has a wall along which coolant liquid flows, said wall having a bore therethrough providing said drain port, said wall at said drain port being subject to formation of a clog layer of said corrosion products, said anti-clog protrusion finger leaving a hole in said clog layer upon removal of said anti-clog protrusion finger from said coolant liquid flow passage upon moving said clog-preventing drain plug to said open position, wherein said drain port extends axially from said coolant liquid flow passage, said clog-preventing drain plug extends axially through said drain port, said coolant liquid flow passage extends laterally across said drain port, and said coolant liquid flows laterally across said anti-clog protrusion finger when said clog-preventing drain plug is in said closed position.

4. A liquid cooled internal combustion engine having a cooling system circulating coolant liquid therethrough and having a coolant liquid flow passage with a drain port for draining of coolant liquid from said coolant liquid flow passage, said drain port being closable to block coolant liquid from exiting therethrough, and being openable to permit coolant liquid to exit therethrough for draining of coolant liquid from said coolant liquid flow passage, said coolant liquid flow passage being subject to carrying corrosion products of said engine, said drain port being subject to clogging by said corrosion products which prevent drainage of coolant liquid from said coolant liquid flow passage through said drain port even if open, a clog-preventing drain plug matingly engageable with said drain port and having closed and open positions, said closed position matingly engaging and closing said drain port to block said coolant liquid from exiting therethrough, said open position opening said drain port to permit coolant liquid to exit therethrough for draining of coolant liquid from said coolant liquid flow passage, said clog-preventing drain plug having an anti-clog protrusion finger extending through said drain port and into said coolant liquid flow passage when said clog-preventing drain plug is in said closed position, wherein said anti-clog protrusion finger occupies space in said coolant liquid flow passage otherwise subject to clogging, wherein said clog-preventing drain plug is movable by an operator between said open and closed positions, and wherein said coolant liquid flow passage has a wall along which coolant liquid flows, said wall having a bore therethrough providing said drain port, said wall at said drain port being subject to formation of a clog layer of said corrosion products, said anti-clog protrusion finger leaving a hole in said clog layer upon removal of said anti-clog protrusion finger from said coolant liquid flow passage upon moving said clog-preventing drain plug to said open position, wherein said anti-clog protrusion finger is flexible and can bend around corners.

5. A clog-preventing replacement drain plug for replacing a standard drain plug in a liquid cooled internal combustion engine having a cooling system circulating coolant liquid therethrough and having a coolant liquid flow passage with a drain port for draining of coolant liquid from said coolant liquid flow passage, said standard drain plug having a closed position matingly engaging and closing said drain port to block said coolant liquid from exiting therethrough and having an open position opening said drain port to permit coolant liquid to exit therethrough for draining of coolant liquid from said coolant liquid passage, said coolant liquid flow passage being subject to carrying corrosion products of said engine, said drain port being subject to clogging by said corrosion products which prevent drainage of coolant liquid from said coolant liquid flow passage through said drain port even if said standard drain plug is in said open position, said clog-preventing replacement drain plug comprising a clog-preventing drain plug matingly engageable with said drain port and having closed and open positions and having an anti-clog protrusion finger extending through said drain port and into said coolant liquid flow passage when said clog-preventing drain plug is in said closed position, wherein said anti-clog protrusion finger extending into said coolant liquid flow passage permits flow of said coolant liquid therepast when said clog-preventing drain plug is in said closed position, such that flow of said coolant liquid through said coolant liquid flow passage is not blocked by said anti-clog protrusion finger when said clog-preventing drain plug is in said closed position.

6. The clog-preventing replacement drain plug according to claim 5 wherein said anti-clog protrusion finger occupies space in said coolant liquid flow passage otherwise subject to clogging.

7. The clog-preventing replacement drain plug according to claim 6 wherein said clog-preventing drain plug is movable by an operator between said open and closed positions, and wherein said coolant liquid flow passage has a wall along which coolant liquid flows, said wall having a bore therethrough providing said drain port, said wall at said drain port being subject to formation of a clog-layer of said corrosion products, said anti-clog protrusion finger leaving a hole in said clog layer upon removal of said anti-clog protrusion finger from said coolant liquid flow passage upon moving said clog-preventing drain plug to said open position, wherein said drain port extends axially from said coolant liquid flow passage, said clog-preventing drain plug extends axially through said drain port, said coolant liquid flow passage extends laterally across said drain port, and said coolant liquid flows laterally across said anti-clog protrusion finger when said clog-preventing drain plug is in said closed position.

8. A clog-preventing replacement drain plug for replacing a standard drain plug in a liquid cooled internal combustion engine having a cooling system circulating coolant liquid therethrough and having a coolant liquid flow passage with a drain port for draining of coolant liquid from said coolant liquid flow passage, said standard drain plug having a closed position matingly engaging and closing said drain port to block said coolant liquid from exiting therethrough and having an open position opening said drain port to permit coolant liquid to exit therethrough for draining of coolant liquid from said coolant liquid passage, said coolant liquid flow passage being subject to carrying corrosion products of said engine, said drain port being subject to clogging by said corrosion products which prevent drainage of coolant liquid from said coolant liquid flow passage through said drain port even if said standard drain plug is in said open position, said clog-preventing replacement drain plug comprising a clog-preventing drain plug matingly engageable with said drain port and having closed and open positions and having an anti-clog protrusion finger extending through said drain port and into said coolant liquid flow passage when said clog-preventing drain plug is in said closed position, wherein said anti-clog protrusion finger occupies space in said coolant liquid flow passage otherwise subject to clogging, wherein said clog-preventing drain plug is movable by an operator between said open and closed positions, and wherein said coolant liquid flow passage has a wall along which coolant liquid flows, said wall having a bore therethrough providing said drain port, said wall at said drain port being subject to formation of a clog-layer of said corrosion products, said anti-clog protrusion finger leaving a hole in said clog layer upon removal of said anti-clog protrusion finger from said coolant liquid flow passage upon moving said clog-preventing drain plug to said open position, wherein said anti-clog protrusion finger is flexible and can bend around corners.

9. A liquid cooled marine internal combustion engine for a marine vessel operating in a body of water, said engine having a cooling system circulating water therethrough from the body of water, said cooling system having a coolant water flow passage with a drain port for seasonal draining of coolant water from said water flow passage to prevent freezing thereof, said drain port being closable to block water from exiting therethrough, and being openable to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if open, a clog-preventing drain plug matingly engageable with said drain port and having closed and open positions, said closed position matingly engaging and closing said drain port to block said water from exiting therethrough, said open position opening said drain port to permit water to exit therethrough for said seasonal draining of coolant water from said water flow passage, said clog-preventing drain plug having an anti-clog protrusion finger extending through said drain port and into said water flow passage when said clog-preventing drain plug is in said closed position, wherein said anti-clog protrusion finger extending into said water flow passage permits flow of water therepast when said clog-preventing drain plug is in said closed position, such that flow of said water through said water flow passage is not blocked by said anti-clog protrusion finger when said clog-preventing drain plug is in said closed position.

10. The water cooled marine internal combustion engine according to claim 9 wherein said anti-clog protrusion finger occupies space in said water flow passage otherwise subject to said clogging.

11. The water cooled marine internal combustion engine according to claim 10 wherein said clog-preventing drain plug is movable by an operator between said open and closed positions, and wherein said water flow passage has a wall along which said water flows, said wall having a bore therethrough providing said drain port, said wall at said drain port being subject to formation of a clog layer of said debris and said corrosion products, said anti-clog protrusion finger leaving a hole in said clog layer upon removal of said anti-clog protrusion finger from said water flow passage upon moving said clog-preventing drain plug to said open position, wherein said drain port extends axially from said water flow passage, said clog-preventing drain plug extends axially through said drain port, said water flow passage extends laterally across said drain port, and said water flows laterally across said anti-clog protrusion finger when said clog-preventing drain plug is in said closed position.

12. A liquid cooled marine internal combustion engine for a marine vessel operating in a body of water, said engine having a cooling system circulating water therethrough from the body of water, said cooling system having a coolant water flow passage with a drain port for seasonal draining of coolant water from said water flow passage to prevent freezing thereof, said drain port being closable to block water from exiting therethrough, and being openable to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if open, a clog-preventing drain plug matingly engageable with said drain port and having closed and open positions, said closed position matingly engaging and closing said drain port to block said water from exiting therethrough, said open position opening said drain port to permit water to exit therethrough for said seasonal draining of coolant water from said water flow passage, said clog-preventing drain plug having an anti-clog protrusion finger extending through said drain port and into said water flow passage when said clog-preventing drain plug is in said closed position, wherein said anti-clog protrusion finger occupies space in said water flow passage otherwise subject to said clogging, wherein said clog-preventing drain plug is movable by an operator between said open and closed positions, and wherein said water flow passage has a wall along which said water flows, said wall having a bore therethrough providing said drain port, said wall at said drain port being subject to formation of a clog layer of said debris and said corrosion products, said anti-clog protrusion finger leaving a hole in said clog layer upon removal of said anti-clog protrusion finger from said water flow passage upon moving said clog-preventing drain plug to said open position, wherein said anti-clog protrusion finger is flexible and can bend around corners.

13. In a marine vessel having a water cooled marine internal combustion engine having a cooling system circulating water therethrough from a body of water in which the vessel is operating and including a coolant water flow passage with a drain port for seasonal draining of coolant water from said water flow passage to prevent freezing thereof, a drain plug having a closed position matingly engaging and closing said drain port to block said water from exiting therethrough, and having an open position opening said drain port to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if said drain plug is in said open position, the improvement comprising a clog-preventing drain plug matingly engageable with said drain port and having said closed and open positions and having an anti-clog protrusion finger extending through said drain port and into said water flow passage when said clog-preventing drain plug is in said closed position, wherein said anti-clog protrusion finger extending into said coolant liquid flow passage permits flow of said coolant liquid therepast when said clog-preventing drain plug is in said closed position, such that flow of said coolant liquid through said coolant liquid flow passage is not blocked by said anti-clog protrusion finger when said clog-preventing drain plug is in said closed position.

14. The clog-preventing drain plug according to claim 13 wherein said anti-clog protrusion finger occupies space in said water flow passage otherwise subject to said clogging.

15. The clog-preventing drain plug according to claim 14 wherein said clog-preventing drain plug is movable by an operator between said open and closed positions, and wherein said water flow passage has a wall along which said water flows, said wall having a bore therethrough providing said drain port, said wall at said drain port being subject to formation of a clog layer of said debris and said corrosion products, said anti-clog protrusion finger leaving a hole in said clog layer upon removal of said anti-clog protrusion finger from said water flow passage upon moving said clog-preventing drain plug to said open position, wherein said drain port extends axially from said coolant liquid flow passage, said clog-preventing drain plug extends axially through said drain port, said coolant liquid flow passage extends laterally across said drain port, and said coolant liquid flows laterally across said anti-clog protrusion finger when said clog-preventing drain plug is in said closed position.

16. In a marine vessel having a water cooled marine internal combustion engine having a cooling system circulating water therethrough from a body of water in which the vessel is operating and including a coolant water flow passage with a drain port for seasonal draining of coolant water from said water flow passage to prevent freezing thereof, a drain plug having a closed position matingly engaging and closing said drain port to block said water from exiting therethrough, and having an open position opening said drain port to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if said drain plug is in said open position, the improvement comprising a clog-preventing drain plug matingly engageable with said drain port and having said closed and open positions and having an anti-clog protrusion finger extending through said drain port and into said water flow passage when said clog-preventing drain plug is in said closed position, wherein said anti-clog protrusion finger occupies space in said water flow passage otherwise subject to said clogging, wherein said clog-preventing drain plug is movable by an operator between said open and closed positions, and wherein said water flow passage has a wall along which said water flows, said wall having a bore therethrough providing said drain port, said wall at said drain port being subject to formation of a clog layer of said debris and said corrosion products, said anti-clog protrusion finger leaving a hole in said clog layer upon removal of said anti-clog protrusion finger from said water flow passage upon moving said clog-preventing drain plug to said open position, wherein said anti-clog protrusion finger is flexible and can bend around corners.

17. A clog-preventing replacement drain plug for replacing a standard drain plug in a water cooled marine internal combustion engine in a marine vessel, said engine having a cooling system circulating water therethrough from a body of water in which the vessel is operating and including a coolant water flow passage with a drain port for seasonal draining of coolant water from said water flow passage to prevent freezing thereof, said standard drain plug having a closed position matingly engaging and closing said drain port to block said water from exiting therethrough and having an open position opening said drain port to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if said standard drain plug is in said open position, said clog-preventing replacement drain plug comprising a clog-preventing drain plug matingly engageable with said drain port and having said closed and open positions and having an anti-clog protrusion finger extending through said drain port and into said water flow passage when said clog-preventing drain plug is in said closed position, wherein said anti-clog protrusion finger extending into said water flow passage permits flow of water therepast when said clog-preventing drain plug is in said closed position, such that flow of said water through said water flow passage is not blocked by said anti-clog protrusion finger when said clog-preventing drain plug is in said closed position.

18. The clog-preventing replacement drain plug according to claim 17 wherein said anti-clog protrusion finger occupies space in said water flow passage otherwise subject to said clogging.

19. The clog-preventing replacement drain plug according to claim 18 wherein said clog-preventing drain plug is movable by an operator between said open and closed positions, and wherein said water flow passage has a wall along which said water flows, said wall having a bore therethrough providing said drain port, said wall at said drain port being subject to formation of a clog layer of said debris and said corrosion products, said anti-clog protrusion finger leaving a hole in said clog layer upon removal of said anti-clog protrusion finger from said water flow passage upon moving said clog-preventing drain plug to said open position, wherein said anti-clog protrusion finger extending into said water flow passage permits flow of said water therepast when said clog-preventing drain plug is in said closed position, such that flow of said water through said water flow passage is not blocked by said anti-clog protrusion finger when said clog-preventing drain plug is in said closed position.

20. A clog-preventing replacement drain plug for replacing a standard drain plug in a water cooled marine internal combustion engine in a marine vessel, said engine having a cooling system circulating water therethrough from a body of water in which the vessel is operating and including a coolant water flow passage with a drain port for seasonal draining of coolant water from said water flow passage to prevent freezing thereof, said standard drain plug having a closed position matingly engaging and closing said drain port to block said water from exiting therethrough and having an open position opening said drain port to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if said standard drain plug is in said open position, said clog-preventing replacement drain plug comprising a clog-preventing drain plug matingly engageable with said drain port and having said closed and open positions and having an anti-clog protrusion finger extending through said drain port and into said water flow passage when said clog-preventing drain plug is in said closed position, wherein said anti-clog protrusion finger occupies space in said water flow passage otherwise subject to said clogging, wherein said clog-preventing drain plug is movable by an operator between said open and closed positions, and wherein said water flow passage has a wall along which said water flows, said wall having a bore therethrough providing said drain port, said wall at said drain port being subject to formation of a clog layer of said debris and said corrosion products, said anti-clog protrusion finger leaving a hole in said clog layer upon removal of said anti-clog protrusion finger from said water flow passage upon moving said clog-preventing drain plug to said open position, wherein said anti-clog protrusion finger is flexible and can bend around corners.

21. A method for preventing clogging of a drain port of a liquid cooled marine internal combustion engine in a marine vessel, said engine having a cooling system circulating water therethrough from a body of water in which the vessel is operating and including a coolant water flow passage with a drain port for seasonal draining of coolant water from said water flow passage to prevent freezing thereof, said drain port having a closed position blocking said water from exiting therethrough and having an open position opening said drain port to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if open, said method comprising providing a clog-preventing drain plug matingly engageable with said drain port and having closed and open positions and having an anti-clog protrusion finger extending through said drain port and into said water flow passage when said clog-preventing drain plug is in said closed position, and comprising matingly engaging said clog-preventing drain plug with said drain port and extending said anti-clog protrusion finger through said drain port and into said water flow passage in said closed position of said clog-preventing drain plug, wherein said anti-clog protrusion finger extending into said water flow passage permits flow of water therepast when said clog-preventing drain plug is in said closed position, such that flow of said water through said water flow passage is not blocked by said anti-clog protrusion finger when said clog-preventing drain plug is in said closed position.

22. The method according to claim 21 comprising occupying space in said water flow passage with said anti-clog protrusion finger otherwise subject to clogging.

23. The method according to claim 22 wherein said water flow passage has a wall along which said water flows, said wall having a bore therethrough providing said drain port, said wall at said drain port being subject to formation of a clog layer of said debris and said corrosion products, and comprising moving said clog-preventing drain plug to said open position to remove said anti-clog protrusion finger from said flow passage and leave a hole in said clog layer, wherein said anti-clog protrusion finger extending into said water flow passage permits flow of said water therepast when said clog-preventing drain plug is in said closed position, such that flow of said water through said water flow passage is not blocked by said anti-clog protrusion finger when said clog-preventing drain plug is in said closed position.

24. A method for preventing clogging of a drain port of a liquid cooled marine internal combustion engine in a marine vessel, said engine having a cooling system circulating water therethrough from a body of water in which the vessel is operating and including a coolant water flow passage with a drain port for seasonal draining of coolant water from said water flow passage to prevent freezing thereof, said drain port having a closed position blocking said water from exiting therethrough and having an open position opening said drain port to permit water to exit therethrough for said seasonal draining of coolant water from said water flow passage, said water flow passage being subject to carrying debris from said body of water in which said vessel is operating and also being subject to carrying corrosion products of said engine, said drain port being subject to clogging by said debris and said corrosion products which prevent drainage of water from said water flow passage through said drain port even if open, said method comprising providing a clog-preventing drain plug matingly engageable with said drain port and having closed and open positions and having an anti-clog protrusion finger extending through said drain port and into said water flow passage when said clog-preventing drain plug is in said closed position, and comprising matingly engaging said clog-preventing drain plug with said drain port and extending said anti-clog protrusion finger through said drain port and into said water flow passage in said closed position of said clog-preventing drain plug, and comprising occupying space in said water flow passage with said anti-clog protrusion finger otherwise subject to clogging, wherein said water flow passage has a wall along which said water flows, said wall having a bore therethrough providing said drain port, said wall at said drain port being subject to formation of a clog layer of said debris and said corrosion products, and comprising moving said clog-preventing drain plug to said open position to remove said anti-clog protrusion finger from said flow passage and leave a hole in said clog layer, and comprising providing said anti-clog protrusion finger as a flexible member and bending said anti-clog protrusion finger around corners as needed.

* * * * *